United States Patent [19]

Hata et al.

[11] Patent Number: 4,696,626

[45] Date of Patent: Sep. 29, 1987

[54] RAILROAD CAR AIR COMPRESSOR UNIT

[75] Inventors: Yasuhisa Hata; Takeshi Hatimaki, both of Akashi; Satoshi Ogura, Kobe, all of Japan

[73] Assignee: Nippon Air Brake Co., Ltd., Kobe, Japan

[21] Appl. No.: 827,848

[22] Filed: Feb. 7, 1986

[30] Foreign Application Priority Data

Feb. 8, 1985 [JP] Japan ..... 60-17472[U]

[51] Int. Cl.[4] ..... F04B 39/16

[52] U.S. Cl. ..... 417/312; 417/313; 417/363

[58] Field of Search ..... 105/1.3, 138, 139; 417/312, 313, 363; 62/296

[56] References Cited

U.S. PATENT DOCUMENTS 2,264,950 12/1941 Melcher ..... 105/1.3 X
3,200,769 8/1965 Dobson et al. ..... 105/138
3,411,705 11/1968 Grover ..... 417/312 X
3,723,027 3/1973 Montelius ..... 417/313
3,918,850 11/1975 Bridigum ..... 417/363
3,936,238 2/1976 Wycliffe ..... 417/312

*Primary Examiner*—Leonard E. Smith
*Attorney, Agent, or Firm*—J. B. Sotak

[57] ABSTRACT

A compact, balanced and lightweight air compressor unit for a railroad vehicle which includes a motor-driven compressor, a suction strainer and suction silencer. The compressor and motor are interconnected by an intermediate hollow flanged mounting member which has a cross-sectional dimension that is smaller than the cross-sectional dimension of the motor and compressor. The suction strainer is located in a space between the motor and compressor and is attached to one side of the intermediate hollow mounting member while the suction silencer is located in a space between the motor and compressor and is attached to the other side of the intermediate hollow mounting member to form a substantially balanced structure which is suspended to the underside of the floor of the railroad vehicle by a plurality of resilient bumper connectors.

5 Claims, 6 Drawing Figures

*Fig.* 1a
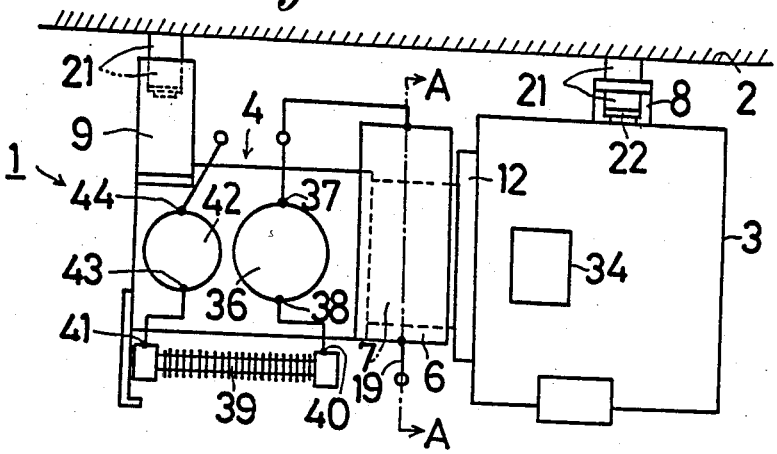
*Fig.* 1b
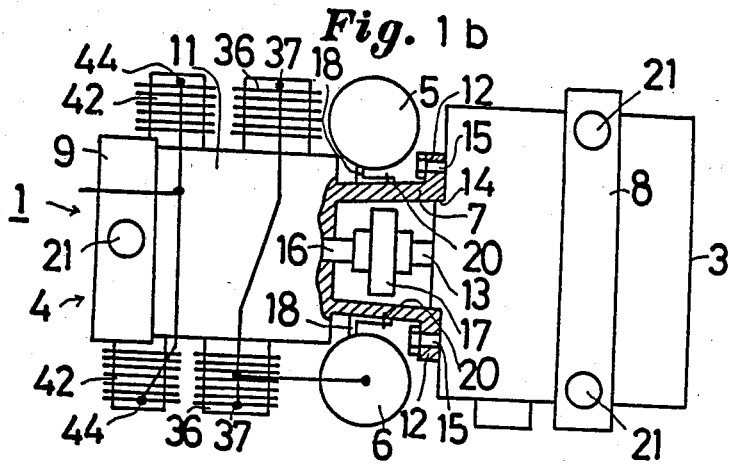
*Fig.* 1c
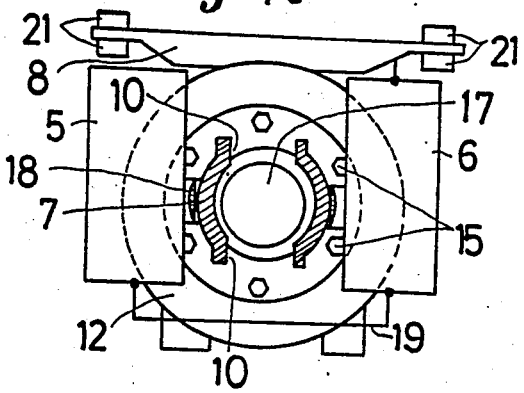

*Fig.* 2a *prior art*
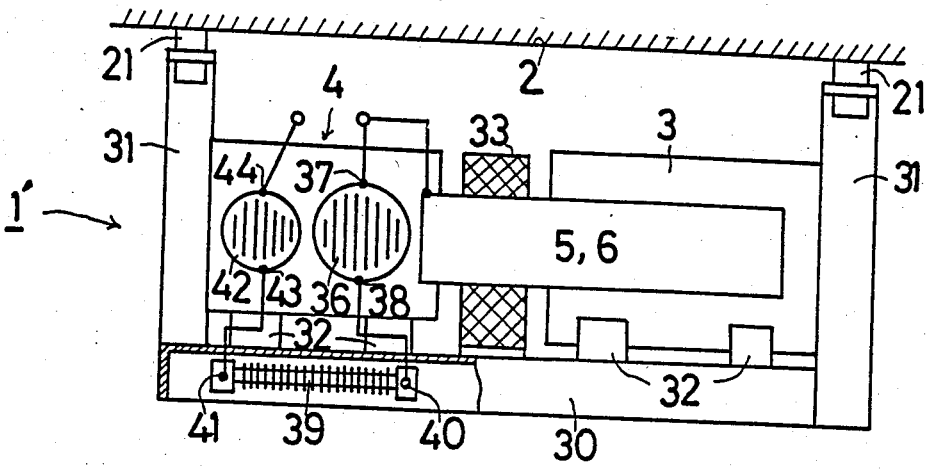
*Fig.* 2b *prior art*
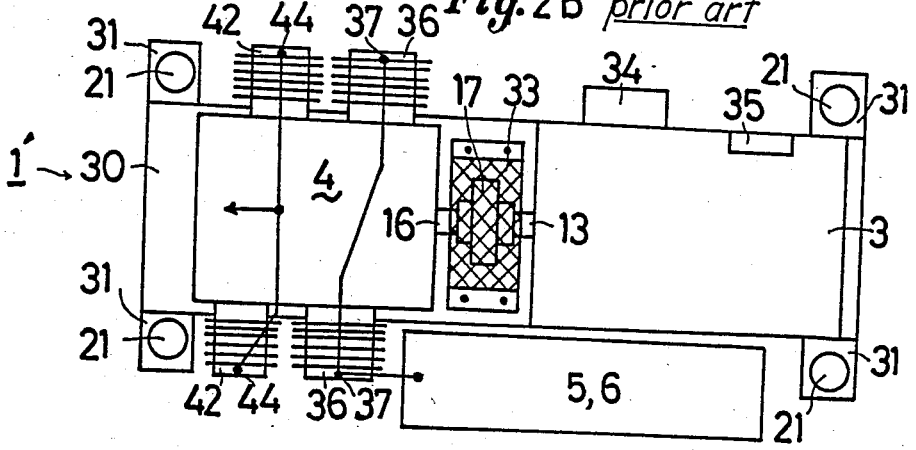
*Fig.* 2c *prior art*
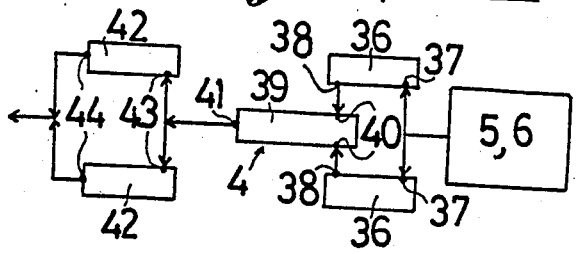

RAILROAD CAR AIR COMPRESSOR UNIT

FIELD OF THE INVENTION

This invention relates to an air compressor unit for a railroad car which is suspended under the railroad car floor and which is equipped with a suction dust filter, a suction muffler, and a compressor which is driven by an electric motor.

BACKGROUND OF THE INVENTION

A railroad car air compressor unit of the prior art is explained in greater detail with reference to FIGS. 2*a*, 2*b*, and 2*c*, which illustrate a side elevational view, a top plan view, and a schematic flow diagram, respectively, of a motor-compressor unit in accordance with the prior art. As shown, a railroad car air compressor unit 1 is suspended underneath the floor 2 of the railroad car and includes an electric motor 3, a compressor 4, a dust suction filter 5, a suction muffler 6, and a base frame 30 which supports and carries the motor, compressor, etc., and four suspension pieces 31 which suspend the base frame 30. The electric motor 3 is located and fixed on one side of the base frame 30 by a plurality of base support members 32. The compressor 4 is located and fixed on the other side of the base frame 30 by another plurality of base support members 32. The rotating shaft 13 of the electric motor 3 and the crank shaft 16 of the compressor 4 are connected via coupling member 17. The outside of this coupling member 17 is covered by the protective cover 33 which is made of a metal mesh which can readily dissipate the heat and which is fixed in a suitable manner to the base frame 30 for safety purposes.

The suction dust filter 5 and the suction muffler 6 are located on one of the sides of the electric motor 3 as a sinlge piece unit, while the terminal box 34 and inspection hatch 35 are located on the other side of the motor. In this type of construction, the air for the compressor 4 comes through the suction dust filter 5 and the suction muffler 6 is divided into the suction inlets 37 of two low-pressure cylinders 36 for pressurization. This pressurized air is then emitted from the outlet 38 of the low-pressure cylinder 36 to the inlet 40 of a middle cooler 39. The cooler 39 is installed at the underside of the base frame 30 so that it releases the heat and is effectively cooled down by the surrounding air. The air is then conveyed from the outlet 41 of the middle cooler 39 to the inlet 43 of the high-pressure cylinder 42 and is further compressed to a higher level. The compressed air from the outlets 44 is connected to a common pipe which leads to the back cooler, not shown in FIGS. 2*a*, 2*b*, and 2*c*.

The four suspension pieces 31 are connected, such as by welding, to the base frame 30 at their lower ends so that the base frame 30 is suspended from each of the four corners thereof. Their upper ends are fixed to the underside of the floor of the cars by suitable bolts or nuts which cooperate with vibration-proof flexible washers or rubber or neoprene dampening mounts 21.

In such an arrangement, the compressor 4 is driven by the motor 3 through the rotation of the rotating shaft 13 which movement is transferred to the crank shaft 16 by the coupling member 17. Thus, the low-pressure cylinder 36 and the high-pressure cylinder 42 are operated, and the air which is sucked in passes through the suction dust filter and the suction muffler. The air is then conducted to two low-pressure cylinders and also to two high-pressure cylinders in the direction shown by the arrows in FIG. 2*c* so that the air is effectively compressed.

It will be appreciated that any dust in the atmosphere is filtered by the suction dust filter 5 to prevent excessive wear to the compressor 4, and the suction sound of the compressor 4 is masked by the suction muffler 6. The vibration which comes from the compressor 4 and/or the electric motor 3 is decreased by the vibration-proof flexible washer dampeners or rubber bumpers 21.

BRIEF DESCRIPTION OF THE DRAWINGS

The invention will be more readily understood by reference to the following portion of the specification when taken in conjunction with the accompanying drawings in which:

FIGS. 1*a*, 1*b*, and 1*c* illustrate a side elevational view, a top plan view, partly in section, and a partial sectional view taken along lines A—A of FIG. 1*a*, respectively, of a preferred embodiment of the present invention.

FIGS. 2*a*, 2*b*, and 2*c* illustrate a side elevational view, a top plan view, and a schematic flow diagram, respectively, of a motor-compressor unit in accordance with the prior art.

Generally, the railroad car air compressor unit 1 is suspended from underside of the car floor 2 which has a very limited amount of available space. In most cases the unit is required to be light in weight and to be compact in shape. Based on such requirements, the base frame 30 of the unit 1 of the prior art is designed to have the necessary minimum area to readily permit the fixation or mounting of the electric motor 3 and the compressor 4. Therefore, the lower ends of the suspension pieces 31 are fixed to the base frame 30 at each of the four corners and extend beyond the outside limits of the base frame 30 and, therefore, the overall exterior dimensions become much larger. Also, the use of such a separate base frame 30 and individual suspension pieces 31 significantly increases the total weight of the compressor unit. Furthermore, the suction dust filter 5 and the suction muffler 6 are attached to the side of the motor 3 so that they are not in the way during maintenance inspection of the equipment, but the outer shape of unit 1 becomes even larger. In addition, since the attachment position of each suspension piece 31 cannot be removed because of various limitations. In addition, the vibration-proof flexible washers or dampeners 21, which are situated between the suspension pieces 31 and the underside of the car floor 2 are unevenly distributed. Further, the motor 3 and the compressor 4, which are the major sources of the vibration conveyed to the base frame 30 and the suspension pieces 31, are remotely located; therefore, the vibration-reducing action is minimal. Also, since the sizes of the motor 3 and the compressor 4 are different, a shim, spacer or the like must be used to adjust the height of each of the bases 32 on the base frame 30 to align the interconnecting shafts. As a result, the assembling of the unit and the centering and shim adjustment requires an excessive amount of time. This, along with the fact that it requires a separate base frame 30, as well as long suspension pieces 31, makes the overall cost of the prior art unit 1 relatively high.

DETAILED DESCRIPTION OF THE INVENTION

The invention was conceived in order to alleviate the above-mentioned shortcomings. The purpose of this invention is to offer a unique railroad car air compressor unit in which a base frame is not necessary, and in which the dust suction filter and the suction muffler can be assembled in a shape so that they do not extend beyond the outside limits of the compressor and motor confines. Further, the suspension is a balanced structure which can be positioned close to the motor and the compressor. Thus, the centering operation is relatively simple and easily accomplished. Accordingly, the unit is compact and lightweight, and has low inertial vibration and low noise production. and is economical to manufacture and assemble.

In practice, the shafts of the motor and the compressor are coupled together, and the housings are interconnected by an intermediate hollow mounting member, which has an outer dimension or diameter that is smaller than the outer dimensions or diameters of the housings of the motor and the compressor. The hollow mounting member has an open end portion having an axially extending flange which cooperates with a matching section formed on the motor housing and/or the compressor housing. The rotating shaft of the motor and the crank shaft of the compressor are interconnected by a coupling member which is located inside of the intermediate hollow mounting member. The suction dust filter and the suction muffler are joined by a pressure connecting conduit and are mounted in a facing position in the space between the motor and the compressor. The motor and compressor are hung by a pair of suspension pieces which are attached to the underside of the floor of the railroad car by suitable vibration-absorbing members.

By employing the techniques and methods as described above, the entire weight of the unit can be appreciably reduced and the imparted vibrational forces can be perceptibly decreased since the motor and the compressor are directly suspended without the use of a base frame, and since the suspension pieces are relatively short and compact. Moreover, since the suction dust filter and the suction muffler are situated and mounted in assigned spaces which are formed between the adjacent ends of the motor and the compressor, they do not extend beyond the outer limits of the motor or compressor housings. Therefore, the filter and muffler do not form obstructions during maintenance inspections of the equipment. Furthermore, the intermediate hollow mounting member is installed to fit a matching or congruous section which is formed concentric to the shaft of the motor and the compressor, therefore, centering and aligning can be easily achieved.

Referring now to the drawings, it will be appreciated that the following is an explanation of an actual embodiment of the invention in which reference is made to FIGS. 1*a*, 1*b*, and 1*c*. The various parts or elements which are the same as those of the prior art described above are identified by the same reference numbers, and their detailed explanations have been omitted. As shown, the railroad car air compressor unit 1 of the subject embodiment is also suspended from beneath the floor 2 of the railroad vehicle or car and mainly includes an electric motor 3, an air compressor 4, a suction dust filter or strainer 5, a suction muffler or silencer 6, and an intermediate flanged hollow mounting member 7, which interconnects and joins motor 3 and the compressor 4 together so that the suspension pieces 8, 9, which jointly suspend the motor 3 and the compressor 4 beneath the floor 2 of the railroad car. It will be seen that the outside dimension or outer diameter of the intermediate hollow mounting member 7 is smaller than the outside dimensions or outer diameters of the housings of the motor 3 and the compressor 4. The open areas 10 are used for heat dissipation. The open areas 10 extend from the top to bottom of the unit. As shown in FIGS. 1*a* and 1*b*, the left end of the top side of the compressor 4 has one suspension piece fixed to the crankcase 11 of the compressor 4, and the right end of the compressor 4 includes an annular flange 12 which is provided with a number of bolt holes. The outer left end of the motor 3, which faces to the compressor 4, is provided with the projection collar 14 which is formed to be concentric with the rotational drive shaft 13.

The motor 3 and the compressor 4 are connected by fitting the circular projection 14 into the flanged end of the intermediate hollow mounting member 7 and being secured to the motor housing 3 by bolts 15. It will be seen that the rotation shaft 13 of the motor 3 and the crankshaft 16 of the compressor 4 are connected together by a coupling member 17. As shown, the suction dust filter 5 and the suction muffler 6 are fixed to one leg of mounting brackets 18 which are disposed and secured to opposite sides of the intermediate hollow mounting member 7. That is, the open spaces or areas 10 formed between the motor 3 and the compressor 4 provide a convenient spot for mounting the filter 5 and muffler 6 to the bracket 18 which has another leg secured to outside surfaces of the hollow mounting member 7. The lower end of the suction dust filter 5 and the suction muffler 6 are connected by the connecting conduit or line 19 running underneath the intermediate hollow mounting member 7. The one leg of bracket 18 is secured to the sides of the intermediate hollow mounting bracket 7 by bolts 20 and the other leg of the bracket 18 is fastened to the suction dust filter 5 and the suction muffler 6 by being welded thereto.

The configuration of the intermediate hollow mounting 7 is not limited to the specific design of the illustrated embodiment as shown in FIGS. 1*a*, 1*b*, and 1*c*. It can be constructed in such a manner that a flange may be formed on both ends which may be fitted onto two projections 14 and connected with the bolts 15. The projections 14 are preferably concentric to the shafts 13 and 16 and are formed on the outer facing end surfaces of the motor 3 and the compressor 4.

Alternatively, the intermediate hollow mounting member 7 can be a structure in which one side end is fixed or forms one piece with the adjacent end bell of the motor 3 and the other end has a flange 12 which fits onto the projection 14 which is formed concentric to the crank shaft 16 on the outer surface of the crankcase 11 of the compressor 4 which faces the motor 3. Furthermore, the centering operation can be accomplished by providing a plurality of fitting pin holes instead of the projection 14. The suspension piece or member 8 for the motor 3 is fixed to the center of the top or upper outer surface of the motor housing 3 and is connected to the underside of the car floor 2 by bolts 22 and by vibration-proof flexible washers 21 or rubber dampeners which are located at both ends. The suspension piece or member 9 for the compressor 4 is fixed to the back end of the top or upper outer surface of the crankcase 11 of the compressor 4 and is connected to the underside of the car floor 2 by bolt 22 by vibration-proof flexible washers or resilient dampening bumpers 21 which is centrally located thereon. The attachment of each suspension piece 8, 9 to the underside of the car 2 can be made by either a one-point connection, or a two-point connection or more. Therefore, the number of connecting points provided by the suspension pieces 8,9 and the underside of the floor of the car 2 should be more than two; however, two to four points are the desirable range.

In the invention described above, since the motor and the compressor are rigidly fixed as a unitary structure by the intermediate hollow mounting member and the motor and the compressor are suspended directly under the car floor by the suspension pieces, a base frame is not necessary and the length and number of the suspension pieces is reduced, so that the entire weight of the unit is appreciably reduced. Also, since the spaces between the motor 3 and compressor 4 are designed to accommodate the suction dust filter and the suction muffler form a balanced structure.

In viewing FIG. 2*b*, it will be seen that the filter and muffler do not extend beyond the outside bounds of the unit, so that the amount of space occupied by the unit as well as its balance are improved thereby resulting in an extremely good design. Furthermore, since the centering operation is relatively simple and easy, the problems due to improper centering or increased vibration are virtually eliminated. In addition, since the assembly time is significantly reduced, the production costs can be greatly decreased.

Further, the suspension pieces are connected directly to the motor or the compressor housings which cause the most vibration so that the connecting positions of these suspension pieces to the underside of the car floor can be chosen freely. Therefore, it can be installed in such a way that each suspension piece receives an equal load, and the action of preventing vibration of the vibration-absorbing material is increased. Therefore, the vibration of the entire unit decreases and, as a result, the breakdown ratio decreases and durability improves.

It will be understood that various alterations and changes may be made by those skilled in the art without departing from the spirit and scope of the subject invention. Therefore, it will be appreciated that certain modifications, ramifications, and equivalents will be readily apparent to a skilled artisan and, accordingly, it is understood that the present invention is not to be limited to the exact embodiment shown and described but should be afforded the full scope and protection of the appended claims.

We claim:

1. A motor-driven air compressor unit for a railroad vehicle comprising, an intermediate hollow mounting member having an outer diameter which is smaller than the outer diameter of the motor and the compressor, said intermediate hollow mounting member has an open flange formed on one end, a matching section formed on one end of the motor so that the compressor is connectable to the motor, the drive shaft of the motor and the crank shaft of the compressor are coupled by a coupling located inside of the intermediate hollow mounting member, and a suction filter and a suction muffler are connected to each other by a connecting line, the suction filter is located in a space formed on one side of the outer surface of the intermediate hollow mounting member and adjacent the ends of the motor and the compressor, the suction muffler is located in a space formed on the other side of the intermediate hollow mounting member and adjacent the ends of the motor and the compressor, and the motor and the compressor are suspended beneath the floor of the railroad vehicle by a pair of suspension pieces which are isolated by vibration-absorbing members.

2. The motor-driven compressor unit according to claim 1, wherein one of the pair of suspension pieces is attached to the top of the motor.

3. The motor-driven air compressor unit, according to claim 1, wherein the motor, the compressor, the suction filter, and the suction muffler form a balanced structure to reduce the adverse effects of the vibrational forces.

4. The motor-driven compressor unit, according to claim 1, wherein each of the vibration-absorbing members takes the form of a resilient dampening bumper.

5. The motor-driven air compressor unit, according to claim 4, wherein the other of the pair of suspension pieces is attached to the top of the air compressor.

* * * * *